US012758856B2

(12) United States Patent
Higginbotham

(10) Patent No.: US 12,758,856 B2
(45) Date of Patent: Oct. 13, 2026

(54) ROLLER BOARD

(71) Applicant: Thomas William Higginbotham, Gardendale, AL (US)

(72) Inventor: Thomas William Higginbotham, Gardendale, AL (US)

( * ) Notice: Subject to any disclaimer, the term of this patent is extended or adjusted under 35 U.S.C. 154(b) by 205 days.

(21) Appl. No.: 18/887,020

(22) Filed: Sep. 16, 2024

(65) Prior Publication Data

US 2025/0010166 A1 Jan. 9, 2025

Related U.S. Application Data

(63) Continuation-in-part of application No. 18/669,512, filed on May 20, 2024, now Pat. No. 12,296,250.

(60) Provisional application No. 63/582,754, filed on Sep. 14, 2023, provisional application No. 63/503,090, filed on May 18, 2023.

(51) Int. Cl.

| | |
|---|---|
| ***A63C 17/06*** | (2006.01) |
| ***A63C 17/14*** | (2006.01) |
| ***A63C 17/22*** | (2006.01) |
| ***A63C 17/24*** | (2006.01) |
| ***A63C 17/26*** | (2006.01) |

(52) U.S. Cl.

CPC ..... *A63C 17/016* (2013.01); *A63C 17/1436* (2013.01); *A63C 17/226* (2013.01); *A63C 17/24* (2013.01); *A63C 17/262* (2013.01)

(58) Field of Classification Search

CPC . A63C 17/016; A63C 17/1436; A63C 17/226; A63C 17/24; A63C 17/262

See application file for complete search history.

(56) References Cited

U.S. PATENT DOCUMENTS

| | | | | |
|---|---|---|---|---|
| 893,341 | A | 7/1908 | Martinsen | |
| 3,086,787 | A | 4/1963 | Wyche | |
| 4,666,168 | A | 5/1987 | Hamill | |
| 5,549,331 | A * | 8/1996 | Yun | A63C 17/004 384/49 |
| 6,186,518 | B1 | 2/2001 | Moses | |
| 6,431,568 | B1 * | 8/2002 | McCleese | A63C 17/01 280/11.223 |
| 7,441,787 | B1 * | 10/2008 | Jordan | A63C 17/006 280/842 |
| 8,308,171 | B2 | 11/2012 | Farrelly | |
| 11,273,363 | B1 * | 3/2022 | DeGraff | A43B 5/16 |
| 2002/0153205 | A1 * | 10/2002 | Zinanti | A63C 17/01 188/1.12 |
| 2008/0191438 | A1 * | 8/2008 | Piaceski | A63C 17/0033 280/87.042 |

(Continued)

*Primary Examiner* — Brian L Swenson

(57) ABSTRACT

A roller board is a board that uses wheels, caster balls, and cleats to mimic the movement of a snowboard. The roller board includes a riding board, a front roller mechanism, and a rear roller mechanism. A user stands upon the riding board and is secured to the riding board. The front roller mechanism and the rear roller mechanism each include an inline-wheeled truck, left and right caster balls, and left and right elongated cleats. The inline-wheel truck allows the roller board to roll in a forward or rearward direction. The left and right caster balls allow a light left or right lean by the user to steer the riding board in either a left or right direction. The left and right elongated cleats allow a heavy left or right lean by the user to brake the riding board from a left or right side of the riding board.

18 Claims, 9 Drawing Sheets

(56) References Cited

U.S. PATENT DOCUMENTS

| | | | | |
|---|---|---|---|---|
| 2009/0045596 | A1 | 2/2009 | Boucher | |
| 2009/0174163 | A1 | 7/2009 | Farrelly | |
| 2010/0090423 | A1* | 4/2010 | Farrelly | A63C 17/01 280/841 |
| 2012/0038121 | A1 | 2/2012 | Chen | |
| 2012/0126523 | A1* | 5/2012 | Langer | A63C 17/045 280/842 |
| 2013/0175777 | A1* | 7/2013 | Bermal | A63C 17/0093 280/87.042 |
| 2016/0175692 | A1* | 6/2016 | Burns | A63C 17/262 280/842 |
| 2016/0228760 | A1* | 8/2016 | Tucker | A63C 17/26 |
| 2018/0185738 | A1* | 7/2018 | Strand | A63C 17/0033 |
| 2021/0245033 | A1 | 8/2021 | Gorden | |
| 2023/0102779 | A1* | 3/2023 | Kermani | A63C 17/0033 280/87.042 |

* cited by examiner

ROLLER BOARD

The current application claims a priority to the U.S. provisional patent application Ser. No. 63/582,754 filed on Sep. 14, 2023. The current application is filed on Sep. 16, 2024, while Sep. 14, 2024 was on a weekend.

The current application is a continuation-in-part (CIP) application of the U.S. non-provisional application Ser. No. 18/669,512 filed on May 20, 2024. The non-provisional application Ser. No. 18/669,512 claims a priority to the U.S. provisional patent application Ser. No. 63/503,090 filed on May 18, 2023. The non-provisional application Ser. No. 18/669,512 was filed on May 20, 2024, while May 18, 2024 was on a weekend.

FIELD OF THE INVENTION

The present invention generally relates to skateboards and snowboards. More specifically, the present invention is a board that uses a combination of a two-wheel in-line truck, ball casters, and cleats to create friction when the user tilts.

BACKGROUND OF THE INVENTION

Typically, during late spring, summer, and early fall month, enough snow accumulation has not occurred to engage in winter sports such as skiing or snowboarding. The lack of snow accumulation also prevents a user from practicing year-round on a winter sport. More specifically, a snowboard is a large board that has some flexibility. The snowboard rider's feet are strapped onto the board to allow control using the heel and toe movement of the feet as well as board positioning by spin movement of the legs. The board is turned using the heel or toe pressure in the desired direction. The more weight or pressure applied to the heel or toe edge, the slower the board moves and can be stopped in this manner. If the rider is completely balanced in the middle of the board, the direction is straight, and the board reaches higher speeds. In addition to turning, pressure can be used to heel or toe to reposition the board at different angles down the slope. Another advantage of snowboard movement is that when tricks are performed, the board is attached to the feet so no effort to "kick up" or "ramp up" the board is needed as is necessary with skateboarding.

Therefore, an objective of the present invention is to provide a board that mimics a snowboard by using a combination of a two-wheel in-line truck, ball casters, and cleats to create friction when the user tilts.

DETAILED DESCRIPTION OF THE INVENTION

Figure 1:
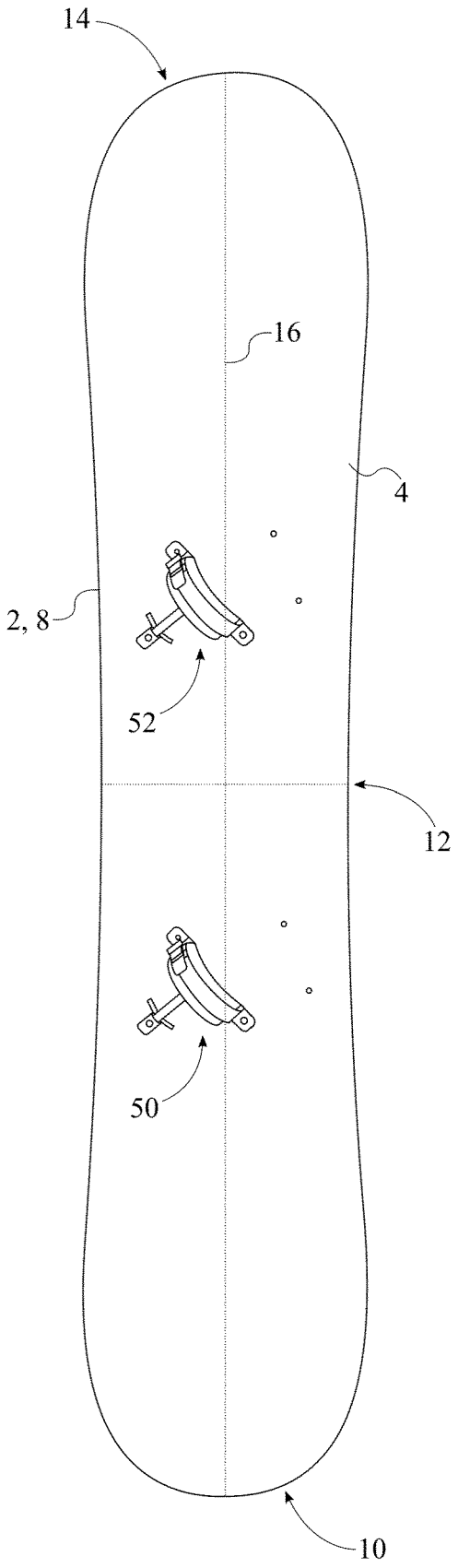
FIG. 1 is a top view of the present invention.
Figure 2:
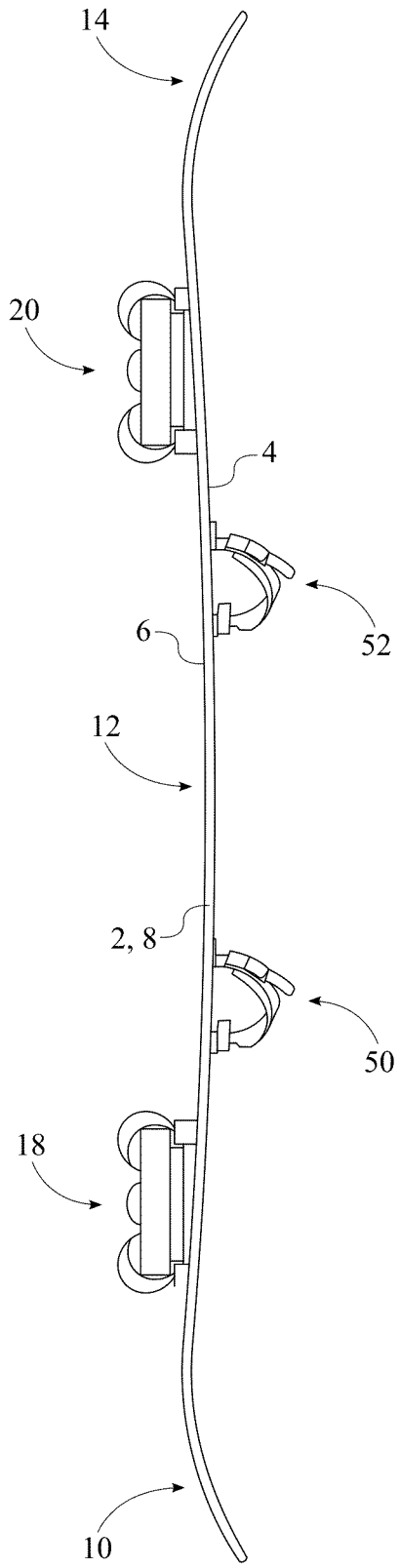
FIG. 2 is a side view of the present invention.
Figure 3:
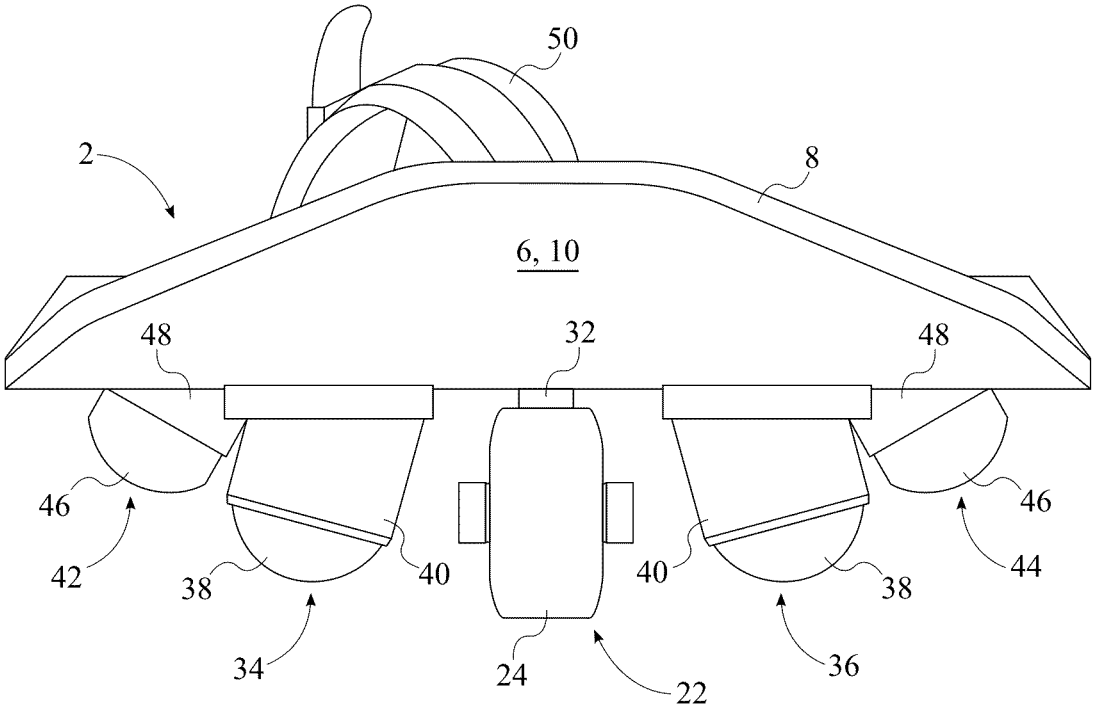
FIG. 3 is a front view of the present invention.
Figure 4:
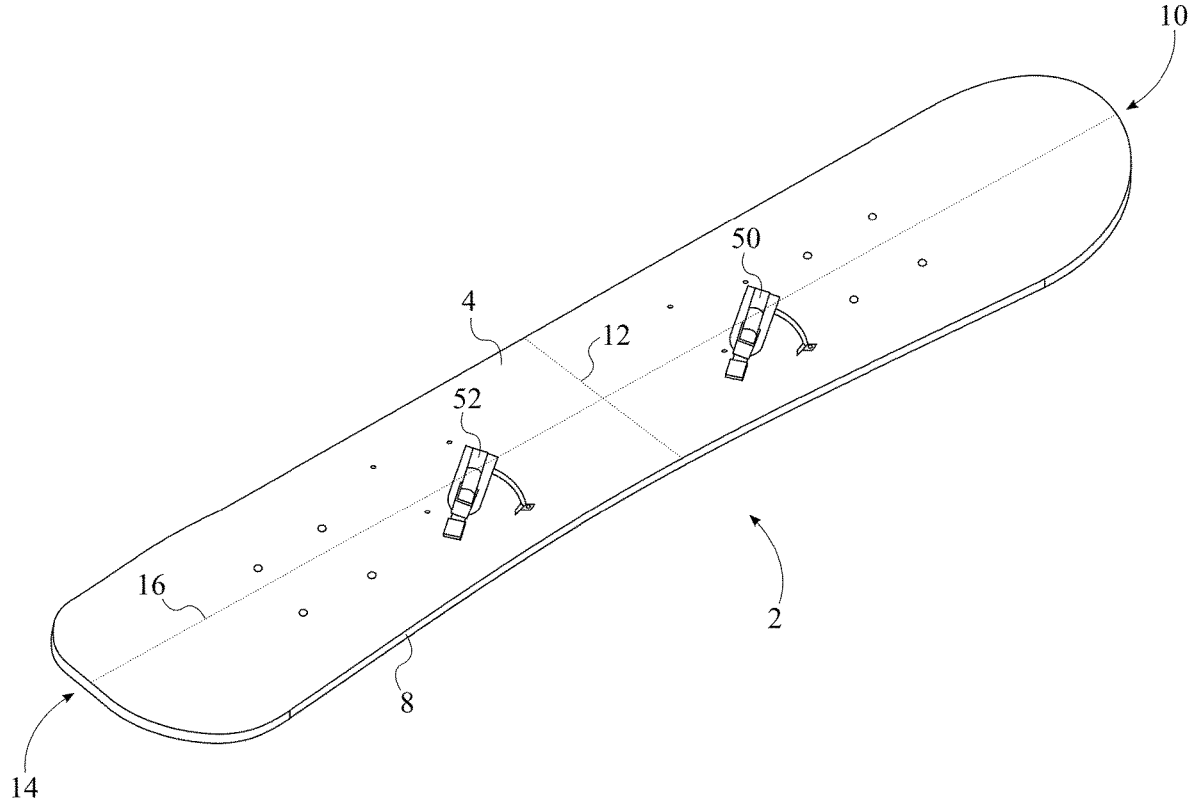
FIG. 4 is an orthographic top view of the present invention.
Figure 5:
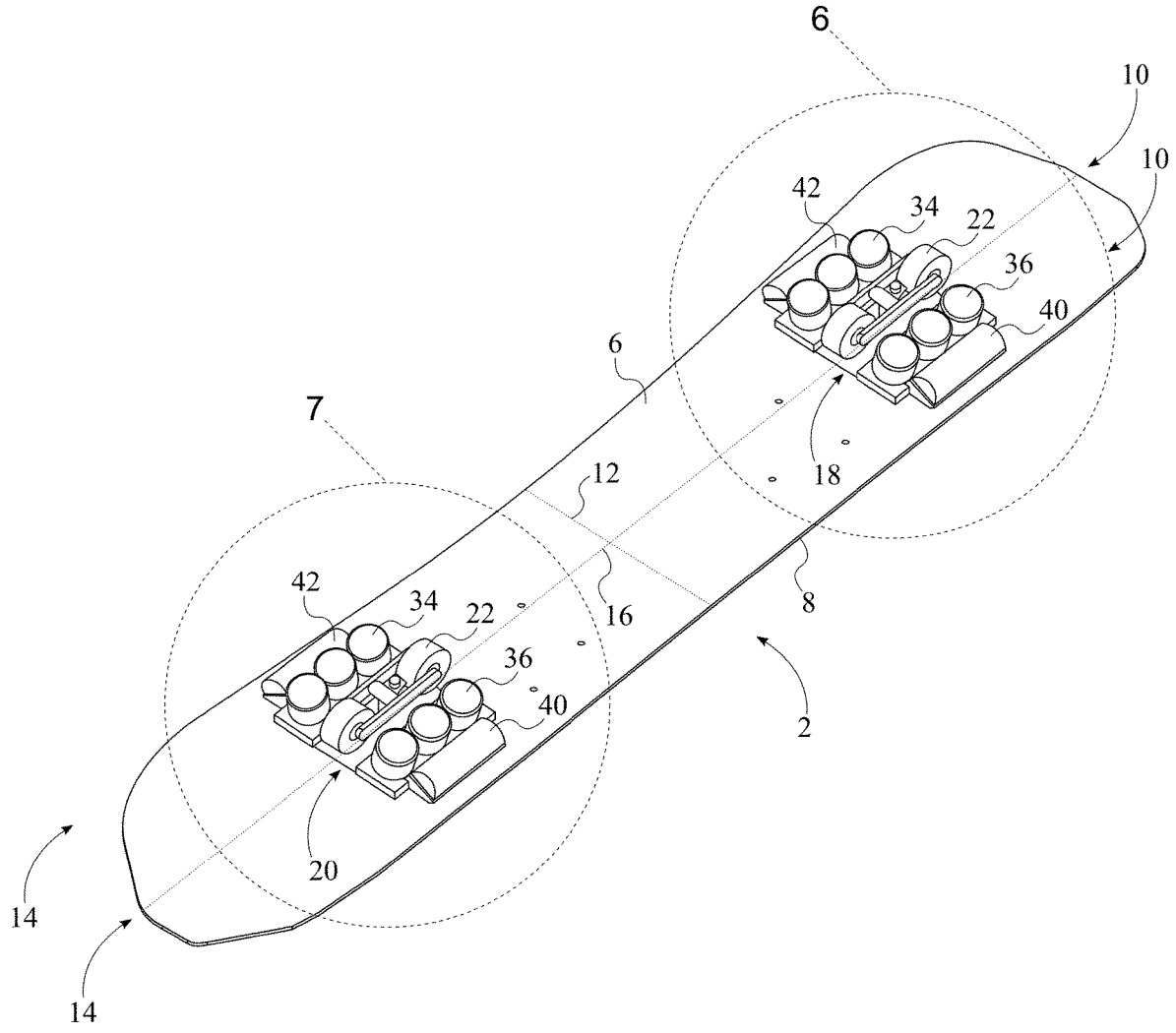
FIG. 5 is an orthographic bottom view of the present invention.
Figure 6:
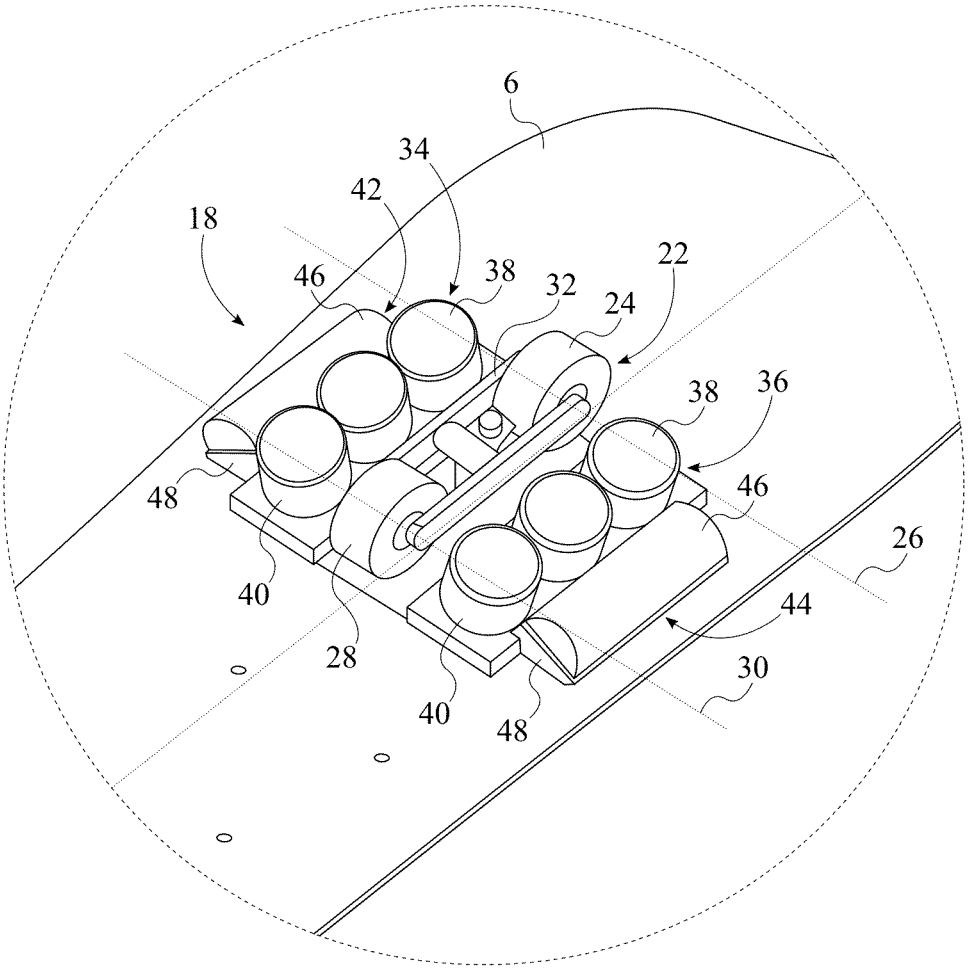
FIG. 6 is a detailed view taken about circle 6 in FIG. 5.
Figure 7:
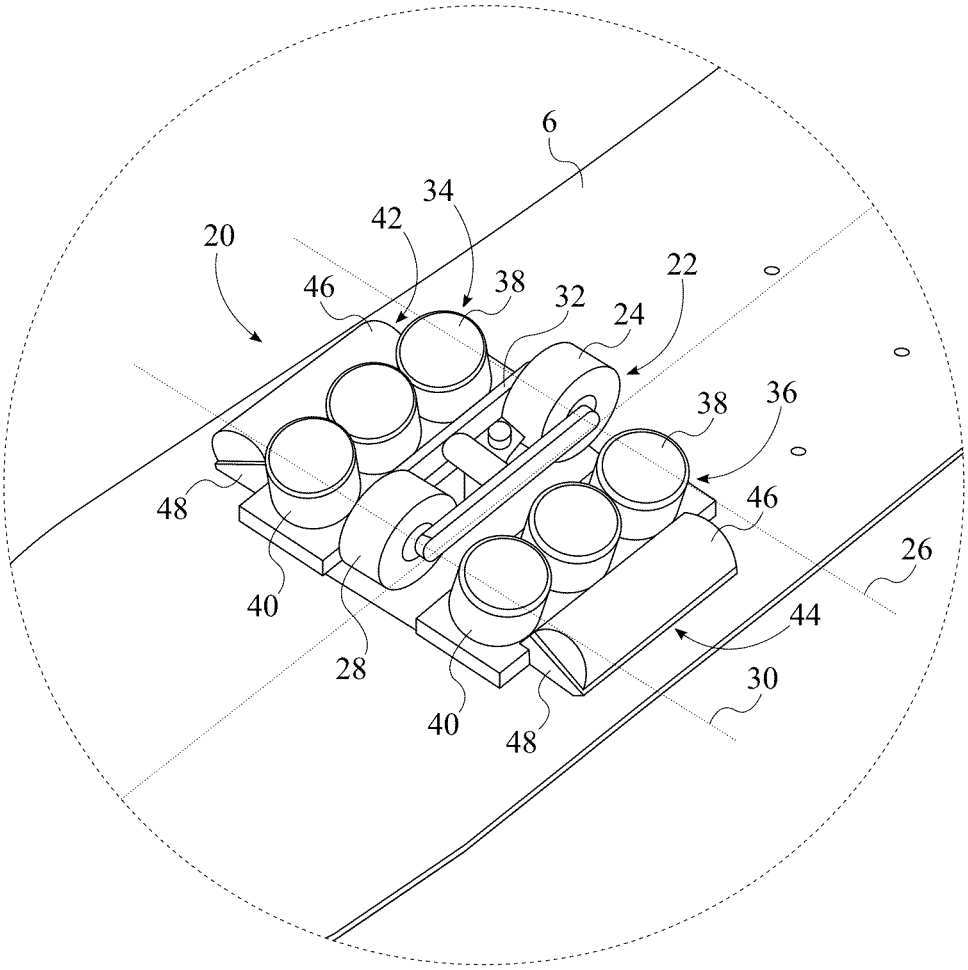
FIG. 7 is a detailed view taken about circle 7 in FIG. 5.

All illustrations of the drawings are for the purpose of describing selected versions of the present invention and are not intended to limit the scope of the present invention.

The present invention is a roller board that allows a user to mimic the typical movements of a snowboard while riding the present invention. Similar to a snowboard, the present invention speeds up if the present invention is aligned parallel to the downward direction of a slope and slows down if the present invention is aligned perpendicular to the downward direction of the slope. Also similar to a snowboard, the present invention can be steered by a user by leaning either in a left direction or a right direction. Thus, the present invention comprises a riding board 2, a front roller mechanism 18, and a rear roller mechanism 20, which can be seen FIGS. 1 through 5. The riding board 2 allows a user to stand upon the present invention and is used to distribute the user's weight between the front roller mechanism 18 and the rear roller mechanism 20. The front roller mechanism 18 allows a user to roll, steer, brake, or a combination thereof with a front portion of the riding board 2, and the rear roller mechanism 20 allows the user to roll, steer, brake, or a combination thereof with a rear portion of the riding board 2.

As can be seen in FIGS. 1 through 5, the riding board 2 is configured similar to the board of a snowboard or the board of a skateboard. Thus, the riding board 2 comprises a top board surface 4, a bottom board surface 6, and an elongated board body 8. While the present invention is in use, the top board surface 4 is oriented away from ground, and the bottom board surface 6 is oriented towards the ground, which allows the top board surface 4 and the bottom board surface 6 to be positioned opposite to each other about the elongated board body 8. The elongated board body 8 is the structural body of the riding board 2 that acts as a base to connect the other components of the present invention together. Moreover, the elongated board body 8 comprises a board nose 10, a board waist 12, and a board tail 14. The board nose 10 is a front end of the elongated board body 8, while the board tail 14 is a rear end of the elongated board body 8. The board waist 12 is a central portion along the elongated board body 8 so that the board waist 12 is positioned in between the board nose 10 and the board tail 14.

The front roller mechanism 18 and the rear roller mechanism 20 are configured to mimic the movement of a snowboard. Thus, the front roller mechanism 18 and the rear roller mechanism 20 each comprise an inline-wheeled truck 22, a plurality of left ball casters 34, a plurality of right ball casters 36, a left elongated cleat 42, and a right elongated cleat 44, which can be seen in FIGS. 1 through 5. The inline-wheeled truck 22 allows the present invention to roll in a forward direction or a rearward direction. The plurality of left ball casters 34 allows the present invention to be steered in a left direction, while the plurality of right ball casters 36 allows the present invention to be steered in a right direction. The left elongated cleat 42 allows the present invention to brake from a left side of the riding board 2, and the right elongated cleat 44 allows the present invention to brake from a right side of the riding board 2.

As can be seen in FIGS. 1 through 5, the general configuration of the aforementioned components allows the present invention to efficiently and effectively mimic the sliding movement of a snowboard with the rolling movement across pavement or another hard surface. The front roller mechanism 18 is positioned in between the board nose 10 and the board waist 12 so that a user's weight distributed to a front portion of the riding board 2 is received by the front roller mechanism 18. The rear roller mechanism 20 is positioned in between the board waist 12 and the board tail 14 so that a user's weight distributed to a rear portion of the riding board 2 is received by the rear roller mechanism 20. The front roller mechanism 18 and the rear roller mechanism 20 are mounted onto the bottom board surface 6, which allows the front roller mechanism 18 and the rear roller mechanism 20 to contact the ground. The inline-wheeled truck 22 is positioned in between the plurality of left ball casters 34 and the plurality of right ball casters 36 so that the inline-wheeled truck 22 exclusively makes contact with the ground when the present invention is ridden in neutral. The inline-wheeled truck 22 and the plurality of left ball casters 34 make contact with the ground at the same time when the present invention is steered with a small left lean by a user. Similarly, the inline-wheeled truck 22 and the plurality of right ball casters 36 make contact with the ground at the same time when the present invention is steered with a small right lean by a user. The inline-wheeled truck 22, the plurality of left ball casters 34, and the plurality of right ball casters 36 are also positioned in between the left elongated cleat 42 and the right elongated cleat 44. This arrangement allows the left elongated cleat 42 and the plurality of left ball casters 34 to make contact with the ground at the same time when the present invention is braked with a heavy left lean by a user. Likewise, this arrangement allows the right elongated cleat 44 and the plurality of right ball casters 36 to make contact with the ground at the same time when the present invention is braked with a heavy right lean by a user. The inline-wheeled truck 22, the left elongated cleat 42, and the right elongated cleat 44 are also positioned parallel to a center lengthwise line 16 of the elongated board body 8 so that the inline-wheeled truck 22, the left elongated cleat 42, and the right elongated cleat 44 for both the front roller mechanism 18 and the rear roller mechanism 20 are able to work in conjunction to roll, steer, or brake the present invention.

As can be seen in FIGS. 1 through 7, the inline-wheeled truck 22 is preferably configured as a pair of wheels in an inline configuration. Thus, the inline-wheeled truck 22 may comprise a first wheel 24, a second wheel 28, and a truck body 32. The first wheel 24 and the second wheel 28 are used to roll on the ground. The first wheel 24 and the second wheel 28 are serially positioned along the center lengthwise line 16, which allows the present invention to roll straight in a forward direction or a rearward direction without any tilt. More specifically, a first rotation axis 26 of the first wheel 24 and a second rotation axis 30 of the second wheel 28 are oriented perpendicular to the center lengthwise line 16, and the first rotation axis 26 of the first wheel 24 and the second rotation axis 30 of the second wheel 28 are oriented parallel to each other. The truck body 32 is a structural body that supports and holds in place the first wheel 24 and the second wheel 28. The truck body 32 is preferably configured as described in the U.S. patent application Ser. No. 18/669,512 (i.e., U.S. patent application Ser. No. 18/669,512 is incorporated by reference). The first wheel 24 and the second wheel 28 are rotatably mounted to the bottom board surface 6 by the truck body 32 so that the first wheel 24 and the second wheel 28 are able to rotate offset from the riding board 2 preventing any mechanical interference from the bottom board surface 6.

As can be seen in FIGS. 1 through 7, each of the plurality of left ball casters 34 and each of the plurality of right ball casters 36 preferably configured as an inelastic ball that can rotate in any direction. Thus, each of the plurality of left ball casters 34 and each of the plurality of right ball casters 36 may each comprise a caster ball 38 and a caster setting 40. The caster ball 38 is an inelastic ball that is able to roll in any direction on the ground. The caster setting 40 is a structural body that supports and holds in place the caster ball 38. The caster ball 38 is rollably mounted to the bottom board surface 6 by the caster setting 40 so that the caster ball 38 is able to roll offset from the riding board 2 preventing any mechanical interference from the bottom board surface 6. Moreover, the plurality of left ball casters 34 is serially positioned along the inline-wheeled truck 22, which allows each of the plurality of left ball casters 34 to make contact with the ground as the inline-wheeled truck 22 is tilted with a light left lean. Also in terms of the plurality of left ball casters 34, the caster setting 40 is positioned adjacent to the inline-wheeled truck 22, and the caster ball 38 is positioned offset from the inline-wheeled truck 22, which allows a user's weight felt on the plurality of left ball casters 34 by a light left lean to be uniformly distributed through the caster setting 40 and the caster ball 38 (i.e., reducing the stress and strain felt by the caster setting 40 and the caster ball 38 for each of the plurality of left ball casters 34). Likewise, the plurality of right ball casters 36 is serially positioned along the inline-wheeled truck 22, opposite to the plurality of left ball casters 34, which allows each of the plurality of right ball casters 36 to make contact with the ground as the inline-wheeled truck 22 is tilted with a light right lean. Also in terms of the plurality of right ball casters 36, the caster setting 40 is positioned adjacent to the inline-wheeled truck 22, and the caster ball 38 is positioned offset from the inline-wheeled truck 22, which allows a user's weight felt on the plurality of right ball casters 36 by a light right lean to be uniformly distributed through the caster setting 40 and the caster ball 38 (i.e., reducing the stress and strain felt by the caster setting 40 and the caster ball 38 for each of the plurality of right ball casters 36).

As can be seen in FIGS. 1 through 7, the left elongated cleat 42 and the right elongated cleat 44 are preferably configured to slide against the ground and to produce a braking friction with a heavy left lean or a heavy right lean by a user of the present invention. Thus, the left elongated cleat 42 and the right elongated cleat 44 may each comprise a cleat stopper 46 and a cleat setting 48. The cleat stopper 46 is an elongated piece of braking material that allows a peripheral left portion or a peripheral right portion of the present invention to slide against the ground, instead of rolling on the ground. The cleat stopper 46 is preferably made of a rubber braking material but can alternatively be made of an abrasion-resistant resistance material (e.g., a hard plastic). The cleat setting 48 is a structural body that supports and holds in place the cleat stopper 46. The cleat stopper 46 is mounted onto the bottom board surface 6 by the cleat setting 48 so that the cleat stopper 46 is able to slide offset from the riding board 2 preventing any mechanical interference from the bottom board surface 6. Moreover, the cleat stopper 46 of the left elongated cleat 42 is positioned along the plurality of left ball casters 34, opposite to the inline-wheeled truck 22, which allows the left elongated cleat 42 to make contact with the ground as the plurality of left ball casters 34 is tilted with a heavy left lean. Also in terms of the left elongated cleat 42, the cleat setting 48 of the left elongated cleat 42 is positioned adjacent to the plurality of left ball casters 34, and the cleat stopper 46 of the left elongated cleat 42 is positioned offset from the plurality of left ball casters 34, which allows a user's weight felt on the left elongated cleat 42 by a heavy left lean to be uniformly distributed through the cleat setting 48 and the cleat stopper 46 (i.e., reducing the stress and strain felt by the cleat setting 48 and the cleat stopper 46 for the left elongated cleat 42). Likewise, the cleat stopper 46 of the right elongated cleat 44 is positioned along the plurality of right ball casters 36, opposite to the inline-wheeled truck 22, which allows the right elongated cleat 44 to make contact with the ground as the plurality of right ball casters 36 is tilted with a heavy right lean. Also in terms of the right elongated cleats 44, the cleat setting 48 of the right elongated cleat 44 is positioned adjacent to the plurality of right ball casters 36, and the cleat stopper 46 of the right elongated cleat 44 is positioned offset from the plurality of right ball casters 36, which allows a user's weight felt on the right elongated cleat 44 by a heavy right lean to be uniformly distributed through the cleat setting 48 and the cleat stopper 46 (i.e., reducing the stress and strain felt by the cleat setting 48 and the cleat stopper 46 for the right elongated cleat 44).

Figure 8:
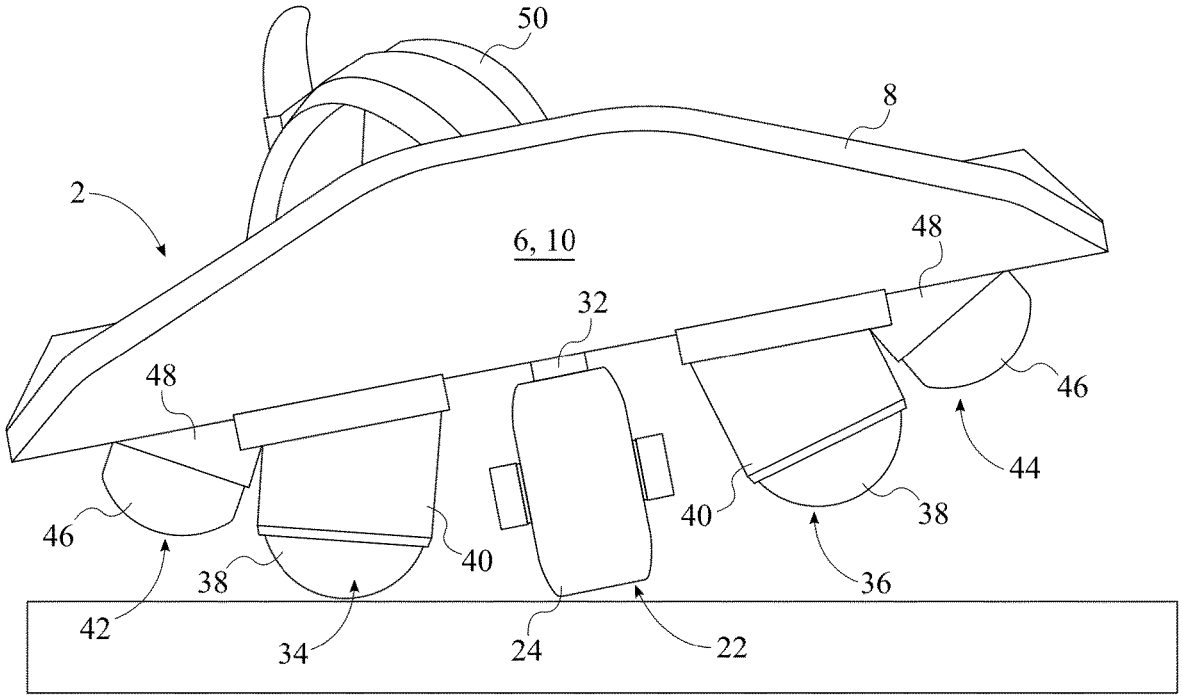
FIG. 8 is a front view of the present invention depicting a soft tilt.
Figure 9:
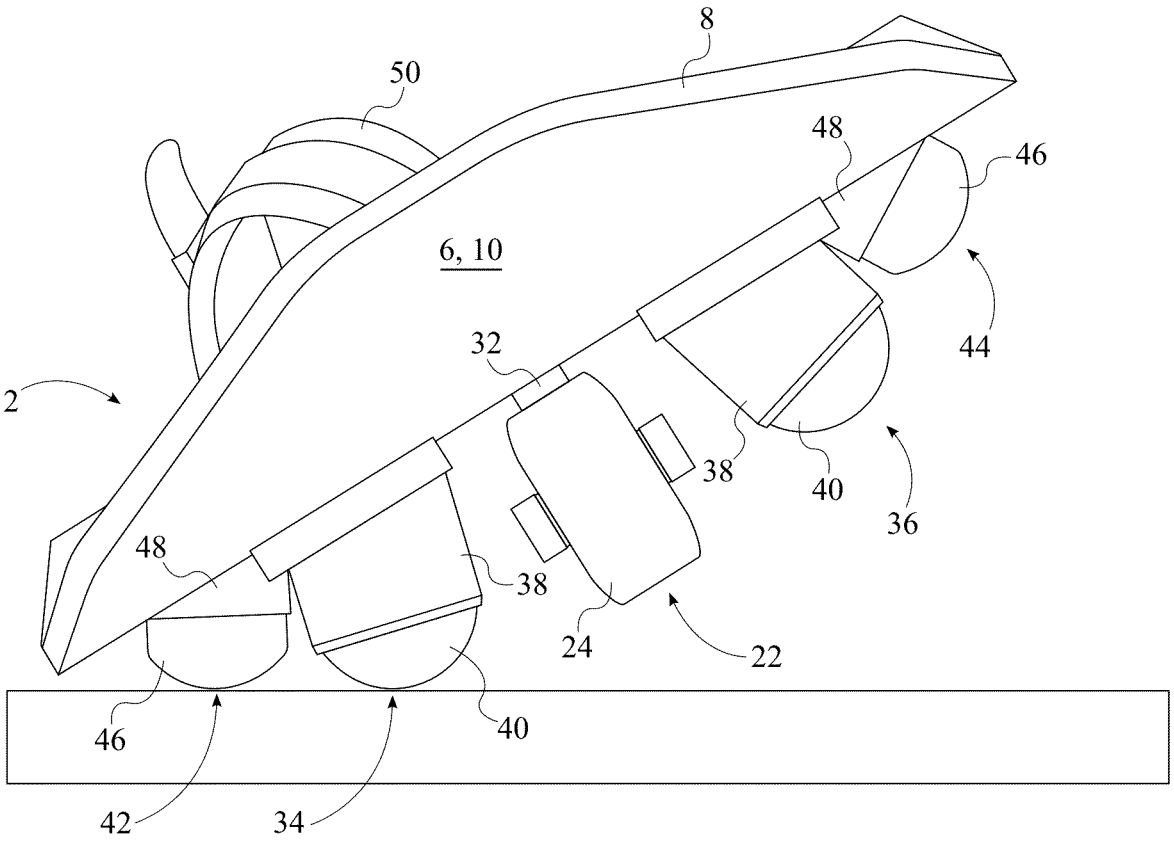
FIG. 9 is a front view of the present invention depicting a hard tilt.

As can be seen in FIGS. 8 and 9, the present invention is preferably configured to mimic the maneuverability of a snowboard, wherein the further heel-side or the further toe-side that the present invention is pressed by a user, the further that the present invention mimics carving heel-side or toe-side. One aspect that allows the present invention to mimic the heel-side/toe-side steering of a snowboard is that a distance between a ground contact point of the inline-wheeled truck 22 and the bottom board surface 6 is greater than a distance between a ground contact point of each of the plurality of left ball casters 34 and the bottom board surface 6, which allows a light left lean to tilt the inline-wheeled truck 22 and simultaneously roll the inline-wheeled truck 22 and the plurality of left ball casters 34 on the ground. Another aspect that allows the present invention to mimic the heel-side/toe-side braking of a snowboard is that a distance between a ground contact point of each of the plurality of left ball casters 34 and the bottom board surface 6 is greater than a distance between a ground contact point of the left elongated cleat 42 and the bottom board surface 6, which allows a heavy left lean to tilt the plurality of left ball casters 34 and simultaneously contact the ground with the plurality of left ball casters 34 and the left elongated cleat 42. Likewise, another aspect that allows the present invention to mimic the toe-side/heel-side steering of a snowboard is that a distance between a ground contact point of the inline-wheeled truck 22 and the bottom board surface 6 is greater than a distance between a ground contact point of each of the plurality of right ball casters 36 and the bottom board surface 6, which allows a light right lean to tilt the inline-wheeled truck 22 and simultaneously roll the inline-wheeled truck 22 and the plurality of right ball casters 36 on the ground. Another aspect that allows the present invention to mimic the toe-side/heel-side braking of a snowboard is that a distance between a ground contact point of each of the plurality of right ball casters 36 and the bottom board surface 6 is greater than a distance between a ground contact point of the right elongated cleat 44 and the bottom board surface 6, which allows a heavy right lean to tilt the plurality of right ball casters 36 and simultaneously contact the ground with the plurality of right ball casters 36 and the right elongated cleat 44.

As can be seen in FIGS. 1 through 4, the present invention also secures a user's feet to the riding board 2 as a way to further mimic a snowboarding experience. Thus, the present invention may further comprise a front foot restraint 50 and a rear foot restraint 52. The front foot restraint 50 is used to secure a forward positioned foot from a regular stance or a goofy stance and is preferably a set of straps that holds the forward position foot in place on the riding board 2. The front foot restraint 50 is positioned in between the board nose 10 and the board waist 12 (i.e., adjacent to the front roller mechanism 18) and is mounted onto the top board surface 4, which secures the forward positioned foot on a front portion of the riding board 2. Likewise, the rear foot restraint 52 is used to secure a rearward positioned foot from a regular stance or a goofy stance and is preferably another set of straps that holds the rearward position foot in place on the riding board 2. The rear foot restraint 52 is positioned in between the board waist 12 and the board tail 14 (i.e., adjacent to the rear roller mechanism 20) and is mounted onto the top board surface 4, which secures the rearward positioned foot on a rear portion of the riding board 2. The present invention may alternatively use a gripping sheet (i.e., a kind of grip tape with grit) adhered onto the top board surface 4 in order to secure a user's feet in place on the riding board 2.

Supplemental Description

The present invention is designed in such a way as to imitate all of the freedom of movement experienced in snowboarding. This is accomplished by using in-line wheels accompanied by large ball casters on each side of the in-line wheel trucks. The four in-line wheels are responsible for the straight-ahead movement and speed, and the ball casters allow for the side-to-side movement of the board. An abrasion-resistant cleat on each side of the sets of ball casters will be positioned to allow for stopping when a more extreme heel or toe angle is maneuvered. The foot insert is adjustable and allows easy access in case of having to jump off the board.

In reference to FIGS. 1 through 9, the present invention consists of a board, foot straps, an abrasion-resistant cleat, two-inch ball casters, a wheel, an in-line wheel truck, and a generic surface (i.e., the ground).

Although the invention has been explained in relation to its preferred embodiment, it is to be understood that many other possible modifications and variations can be made without departing from the spirit and scope of the invention.

What is claimed is:

1. A roller board comprising:

a riding board;

a front roller mechanism;

a rear roller mechanism;

the riding board comprising a top board surface, a bottom board surface, and an elongated board body;

the front roller mechanism and the rear roller mechanism each comprising an inline-wheeled truck, a plurality of left ball casters, a plurality of right ball casters, a left elongated cleat, and a right elongated cleat;

the elongated board body comprising a board nose, a board waist, and a board tail;

the top board surface and the bottom board surface being positioned opposite to each other about the elongated board body;

the board waist being positioned in between the board nose and the board tail;

the front roller mechanism being positioned in between the board nose and the board waist;

the rear roller mechanism being positioned in between the board waist and the board tail;

the front roller mechanism and the rear roller mechanism being mounted onto the bottom board surface;

the inline-wheeled truck being positioned in between the plurality of left ball casters and the plurality right ball casters;

the inline-wheeled truck, the plurality of left ball casters, and the plurality of right ball casters being positioned in between the left elongated cleat and the right elongated cleat; and the inline-wheeled truck, the left elongated cleat, and the right elongated cleat being positioned parallel to a center lengthwise line of the elongated board body.

2. The roller board as claimed in claim 1 comprising:

the inline-wheeled truck comprising a first wheel, a second wheel, and a truck body;

the first wheel and the second wheel being serially positioned along the center lengthwise line;

a first rotation axis of the first wheel and a second rotation axis of the second wheel being oriented perpendicular to the center lengthwise line;

the first rotation axis of the first wheel and the second rotation axis of the second wheel being oriented parallel to each other; and the first wheel and the second wheel being rotatably mounted to the bottom board surface by the truck body.

3. The roller board as claimed in claim 1 comprising:

each of the plurality of left ball casters comprising a caster ball and a caster setting;

the plurality of left ball casters being serially positioned along the inline-wheeled truck; and the caster ball being rollably mounted to the bottom board surface by the caster setting.

4. The roller board as claimed in claim 3 comprising:

the caster setting being positioned adjacent to the inline-wheeled truck; and the caster ball being positioned offset from the inline-wheeled truck.

5. The roller board as claimed in claim 1 comprising:

each of the plurality of right ball casters comprising a caster ball and a caster setting;

the plurality of right ball casters being serially positioned along the inline-wheeled truck; and the caster ball being rollably mounted to the bottom board surface by the caster setting.

6. The roller board as claimed in claim 5 comprising:

the caster setting being positioned adjacent to the inline-wheeled truck; and the caster ball being positioned offset from the inline-wheeled truck.

7. The roller board as claimed in claim 1 comprising:

the left elongated cleat comprising a cleat stopper and a cleat setting;

the cleat stopper of the left elongated cleat being positioned along the plurality of left ball casters; and the cleat stopper being mounted onto the bottom board surface by the cleat setting.

8. The roller board as claimed in claim 7 comprising:

the cleat setting of the left elongated cleat being positioned adjacent to the plurality of left ball casters; and the cleat stopper of the left elongated cleat being positioned offset from the plurality of left ball casters.

9. The roller board as claimed in claim 7, wherein the cleat stopper is made of a rubber braking material.

10. The roller board as claimed in claim 1 comprising:

the right elongated cleat comprising a cleat stopper and a cleat setting;

the cleat stopper of the right elongated cleat being positioned along the plurality of right ball casters; and the cleat stopper being mounted onto the bottom board surface by the cleat setting.

11. The roller board as claimed in claim 10 comprising:

the cleat setting of the right elongated cleat being positioned adjacent to the plurality of right ball casters; and the cleat stopper of the right elongated cleat being positioned offset from the plurality of right ball casters.

12. The roller board as claimed in claim 10, wherein the cleat stopper is made of a rubber braking material.

13. The roller board as claimed in claim 1, wherein a distance between a ground contact point of the inline-wheeled truck and the bottom board surface is greater than a distance between a ground contact point of each of the plurality of left ball casters and the bottom board surface.

14. The roller board as claimed in claim 1, wherein a distance between a ground contact point of the inline-wheeled truck and the bottom board surface is greater than a distance between a ground contact point of each of the plurality of right ball casters and the bottom board surface.

15. The roller board as claimed in claim 1, wherein a distance between a ground contact point of each of the plurality of left ball casters and the bottom board surface is greater than a distance between a ground contact point of the left elongated cleat and the bottom board surface.

16. The roller board as claimed in claim 1, wherein a distance between a ground contact point of each of the plurality of right ball casters and the bottom board surface is greater than a distance between a ground contact point of the right elongated cleat and the bottom board surface.

17. The roller board as claimed in claim 1 comprising:

a front foot restraint;

the front foot restraint being positioned in between the board nose and the board waist; and the front foot restraint being mounted onto the top board surface.

18. The roller board as claimed in claim 1 comprising:

a rear foot restraint;

the rear foot restraint being positioned in between the board waist and the board tail; and the rear foot restraint being mounted onto the top board surface.

* * * * *